US006516179B1

(12) United States Patent
Sawai et al.

(10) Patent No.: US 6,516,179 B1
(45) Date of Patent: Feb. 4, 2003

(54) IMAGE FORMING APPARATUS, IMAGE TRANSFERRING DEVICE AND RECORDING MEDIUM CONVEYING METHOD

(75) Inventors: Yuuji Sawai, Kanagawa (JP); Toshiaki Motohashi, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/696,959

(22) Filed: Oct. 27, 2000

(30) Foreign Application Priority Data

| | | |
|---|---|---|
| Oct. 29, 1999 | (JP) | 11-308404 |
| Apr. 14, 2000 | (JP) | 2000-113703 |
| Aug. 21, 2000 | (JP) | 2000-249856 |

(51) Int. Cl.[7] ..... G03G 15/00; G03G 15/16
(52) U.S. Cl. ..... 399/388; 399/316
(58) Field of Search ..... 399/297, 316, 399/317, 390, 388

(56) References Cited

U.S. PATENT DOCUMENTS

| | | | | |
|---|---|---|---|---|
| 5,155,539 A | * | 10/1992 | Yamaguchi et al. | 399/317 |
| 5,182,604 A | * | 1/1993 | Asai | 399/297 |
| 5,424,818 A | * | 6/1995 | Yoshimura et al. | 399/316 |
| 5,442,428 A | | 8/1995 | Takahashi et al. | |
| 5,453,823 A | * | 9/1995 | Hashizume et al. | 399/316 |
| 5,461,461 A | | 10/1995 | Harasawa et al. | |
| 5,483,330 A | | 1/1996 | Ogiyama et al. | |
| 5,617,193 A | * | 4/1997 | Ban et al. | 399/316 |
| 5,666,622 A | | 9/1997 | Harasawa et al. | |
| 5,729,788 A | * | 3/1998 | Hirohashi et al. | 399/388 |
| 5,758,226 A | | 5/1998 | Motohashi | |
| 5,812,923 A | * | 9/1998 | Yamauchi et al. | 399/390 |
| 5,870,650 A | | 2/1999 | Takahashi et al. | |
| 5,890,030 A | | 3/1999 | Namekata et al. | |
| 5,983,060 A | | 11/1999 | Namekata et al. | |
| 6,035,157 A | | 3/2000 | Takahashi et al. | |
| 6,097,925 A | * | 8/2000 | Nagaoka et al. | 399/316 |
| 6,163,661 A | | 12/2000 | Namekata et al. | |
| 6,192,205 B1 | | 2/2001 | Motohashi | |
| 6,256,472 B1 | * | 7/2001 | Miyake et al. | 399/316 |

FOREIGN PATENT DOCUMENTS

| | | | |
|---|---|---|---|
| JP | 5-046031 | | 2/1993 |
| JP | 5-061365 | | 3/1993 |
| JP | 5-341670 | | 12/1993 |
| JP | 6-003974 | | 1/1994 |
| JP | 10-039648 | | 2/1998 |
| JP | 2000-075676 | | 3/2000 |
| JP | 2001-117375 | * | 4/2001 |
| JP | 2001-194916 | * | 7/2001 |
| JP | 2001-255754 | * | 9/2001 |

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

An image forming apparatus of the present invention includes an intermediate transfer belt to which a toner image is transferred from an image carrier. A transfer roller contacts the intermediate transfer belt, forming a nip for image transfer. The transfer roller causes the toner image to be transferred from the intermediate transfer belt to a recording medium at the nip. A first and a second guide member cooperate to guide the recording medium to the nip. The end of the second guide member is positioned at the intermediate transfer belt side with respect to a line connecting a restriction point included in the first guide member and the inlet of the nip. This configuration causes a portion of the recording medium rearward of a portion entered the nip to bend in a convex configuration. The recording medium therefore surely remains in close contact with the intermediate transfer belt in a region where pretransfer is apt to occur.

19 Claims, 5 Drawing Sheets

IMAGE FORMING APPARATUS, IMAGE TRANSFERRING DEVICE AND RECORDING MEDIUM CONVEYING METHOD

BACKGROUND OF THE INVENTION

The present invention relates to a copier, facsimile apparatus, printer or similar image forming apparatus, a device for transferring a color image from an intermediate transfer body to a recording medium, and a method of conveying a recording medium to a transfer region where a color image is to be transferred from an image carrier to the recording medium.

One of conventional image forming apparatuses includes an image carrier and an elastic transfer member contacting the image carrier and forming a nip or transfer region between it and the image carrier. A bias for image transfer is applied to the nip in order to transfer a color image electrostatically carried on the image carrier to a paper sheet or similar recording medium. A gap exists between the image carrier and the transfer member at each of the upstream side and downstream side in a direction in which the recording medium is conveyed (direction of conveyance hereinafter). The bias for image transfer forms electric fields in such gaps also.

Assume that a paper sheet is present in the gap at the upstream side in the direction of transfer and spaced from the image carrier. Then, the electric field formed in the gap causes a color image formed on the image carrier to fly toward the paper sheet, resulting in so-called pretransfer. Let the region where the pretransfer occurs be referred to as a pretransfer region. Toner is scattered around an expected image as a result of the pretransfer. This problem arises not only in an image forming apparatus of the type pressing a paper sheet against an image carrier from the side of the paper sheet opposite to the image transfer side, but also in an image forming apparatus of the type effecting image transfer by causing the image transfer side of a paper sheet to contact an image carrier. The latter type of image forming apparatus may be one in which a transfer charger charges a paper sheet from the side of the paper sheet opposite to the image transfer side in order to form an electric field for image transfer.

It is a common practice with a full-color copier or similar full-color image forming apparatus to transfer a toner image or color image from a photoconductive element to an intermediate transfer body (primary transfer) and then to a paper sheet being conveyed in close contact with the intermediate transfer body (secondary transfer). In this case, the scattering of toner ascribable to the pretransfer blurs the toner image on the paper sheet.

Presumably, a paper sheet parts from the image carrier in the pretransfer region due to the following two different causes. One causes relates to the curvature of the image carrier in the transfer region while the other cause relates to a manner in which guide members guide a paper sheet toward the nip, as will be described specifically later with reference to the accompanying drawings.

Japanese Patent Laid-Open Publication No. 6-3974 discloses an image forming apparatus including a countermeasure against the scattering of toner to occur in the pretransfer region. The image forming apparatus includes a transfer member for electrostatically transferring a toner image from an image carrier to a paper sheet. The transfer member and image carrier form a nip therebetween. An upper or first guide member and a lower or second guide member cooperate to guide a paper sheet to a transfer position. The ends of the upper and lower guide members positioned at the most downstream side in the direction of conveyance are located on or above a line tangential to the image carrier at the most upstream point of the nip. Further, the angle between the guide surface of each of the two guide members and the horizontal is selected to be smaller than the angle between the above tangential line and the horizontal.

The upper and lower guide members, satisfying the above-described conditions, allow a paper sheet to enter the nip in contact with the image carrier. The document teaches that a gap causative of the pretransfer does not exist between the image carrier and the paper sheet in the pretransfer region. The paper sheet, in accordance with the document, contacts the image carrier and then enters the nip, i.e., it does not directly enter the nip. However, the point of the image carrier that the leading edge of the paper sheet contacts is dependent on the degree of flexibility of the paper sheet. If the distance between the above point of the image carrier and the inlet of the nip is excessively great, the paper sheet noticeably bends due to a difference in conveying speed between a registration roller pair and the transfer member. The bend of the paper sheet is apt to occur in the pretransfer region. It is therefore likely that the paper sheet parts from an intermediate transfer belt in the pretransfer region.

Technologies relating to the present invention are also disclosed in, e.g., Japanese Patent Laid-Open Publication Nos. 5-46031, 5-61365, 5-341670, 10-39648 and 2000-75676.

SUMMARY OF THE INVENTION

It is therefore an object of the present invention to provide an image forming apparatus, an image transferring device and a recording medium conveying method capable of obviating pretransfer by maintaining a recording medium in close contact with an image carrier in a pretransfer region and thereby insuring attractive images free from the scattering of toner.

In accordance with the present invention, an image forming apparatus includes an image carrier for carrying a color image thereon. An elastic transfer member contacts the image carrier to thereby form a nip for electrostatically transferring the color image from the image carrier to a recording medium, and causes the recording medium being conveyed toward the nip to contact the image carrier and then enter the nip. A first guide member guides one side of the recording medium expected to receive the color image to the nip. The first guide includes, in a portion thereof contacting the recording medium other than the leading and trailing edges of the medium in the direction of conveyance while guiding the medium, a first restriction point located at the most downstream side in the above direction. A second guide member guides the other side of the recording medium to the nip. The second guide member includes, in a portion thereof contacting the recording medium other than the leading and trailing edges of the medium in the direction of conveyance while guiding the medium, a second restriction point located at the most downstream side in the direction of conveyance and downstream of the first restriction point. The first and second guide members are positioned such that the first restriction point is positioned at the opposite side to the image carrier with respect to a reference line connecting the second restriction point and the upstream end of the nip in the direction of conveyance.

Also, in accordance with the present invention, in a method of conveying a recording medium, to which a color image is to be electrostatically transferred from an image carrier, to a nip for image transfer formed between the image carrier and an elastic transfer member such that the medium contacts the image carrier and then enters the nip, the medium is conveyed while being restricted such that the most downstream point of a restricting portion, which restricts the image transfer side of the medium, other than opposite ends in the direction of conveyance is positioned at the opposite side to the image carrier with respect to a reference line connecting the most downstream point of a restricting portion, which restricts the other side of the medium, other than opposite ends in the direction of conveyance and the upstream end of the nip in the above direction.

Further, in accordance with the present invention, an image forming apparatus includes an intermediate transfer body for carrying a color image thereon. A transferring device conveys a recording medium while causing it to bend and move along a part of the intermediate transfer body positioned at the upstream side in a direction of conveyance in a transfer region, in which a color image formed on the intermediate transfer body is transferred to the medium. A contact assisting member is positioned upstream of the transfer region in the direction of conveyance for maintaining the recording medium and intermediate transfer body in close contact with each other.

Moreover, in accordance with the present invention, in an image transferring device for transferring a color image formed on an intermediate transfer body to a recording medium being conveyed by being warped such that the medium moves along part of the intermediate transfer body positioned upstream of a transfer region in a direction of conveyance, a contact assisting member is positioned upstream of the transfer region in the above direction and configured to maintain the medium and intermediate transfer body in close contact with each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, the previously mentioned two causes of separation of a paper sheet from an image carrier in a pretransfer region will be described specifically.

Figure 1:
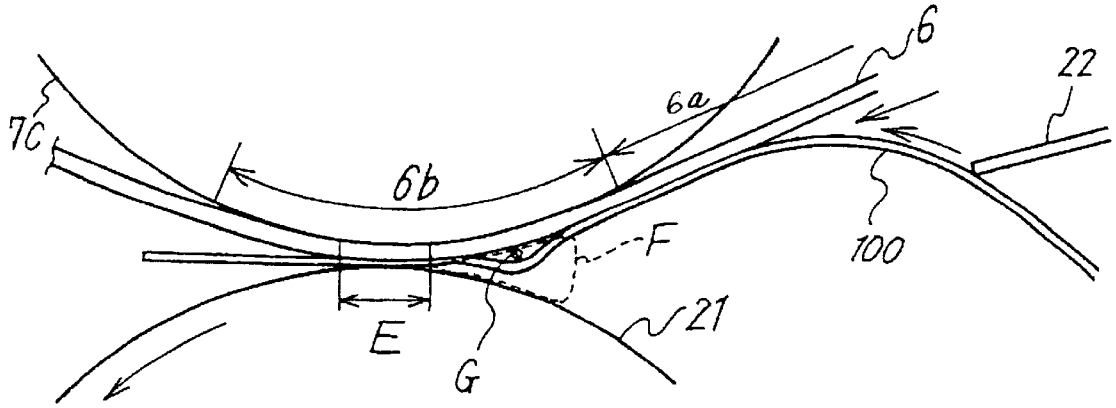
FIG. 1 PRIOR ART
FIG. 1 is a view showing part of a conventional full-color image forming apparatus of the type including an intermediate transfer unit.

The first cause relates to the curvature of an image carrier in a transfer region. This will be described with reference to FIG. 1 showing a secondary transfer region included in a conventional full-color image forming apparatus of the type using an intermediate transfer unit. As shown, an intermediate transfer belt or image carrier (simply belt hereinafter) 6 and a transfer roller or elastic transfer member 21 form a nip E for promoting accurate image transfer. The belt 6 includes a flat portion 6*a* and a curved portion 6*b*. A paper sheet or similar recording medium 100 is conveyed by a registration roller pair, not shown, along a guide 22. The leading edge of the paper sheet 100 first contacts the flat portion 6*a* of the belt 6. The paper sheet 100 is then conveyed along the belt 6 to the nip E. The paper sheet 100 being so conveyed warps upward at the upstream side in the direction of paper conveyance, as illustrated. The belt 100 is therefore brought into close contact with the belt 6.

A counter roller 7*c*, facing the elastic transfer roller 21, causes the belt 6 to curve around the nip E, as illustrated. To maintain the close contact of the paper sheet 100 with the curved portion 6*b* of the belt 6 in the above condition, it is necessary to cause the paper sheet 100 to curve complementarily to the curved portion 6*b*. However, the curved portion of the paper sheet 100 tends to rebound in the direction of the imaginary extension of the flat portion 6*a* due to its flexibility. In addition, when the paper sheet 100 is nipped at the nip E, the curved portion of the paper sheet 100 tends to rebound in the direction of a line tangential to the belt 6 and roller 21 at the upstream end of the nip E in the direction of conveyance. Consequently, part of the paper sheet 100 around the inlet of the nip E is biased away from the belt 6.

Further, the speed at which the paper sheet 100 is conveyed via the nip E is usually lower than the speed at which it is conveyed by the registration roller pair. Therefore, when the paper sheet 10 is caused to slowly warp upward at the position upstream of the nip E while being conveyed, the paper sheet 100 bends around the inlet of the nip due to the above-described tendency to rebound, as shown in FIG. 1. As a result, the entire paper sheet 100 is slowly deformed in the form of a letter S and is not always complementary in shape to the belt 6. A small gap G therefore appears between the belt 6 and the paper sheet 100 in a pretransfer region F just short of the nip E, so that the paper sheet 100 parts from the belt 6 in the pretransfer region F. Particularly, when the counter roller 7*c* is positioned vertically above the transfer roller 21, gravity aggravates the parting of the paper sheet 100 from the belt 6.

Figure 2:
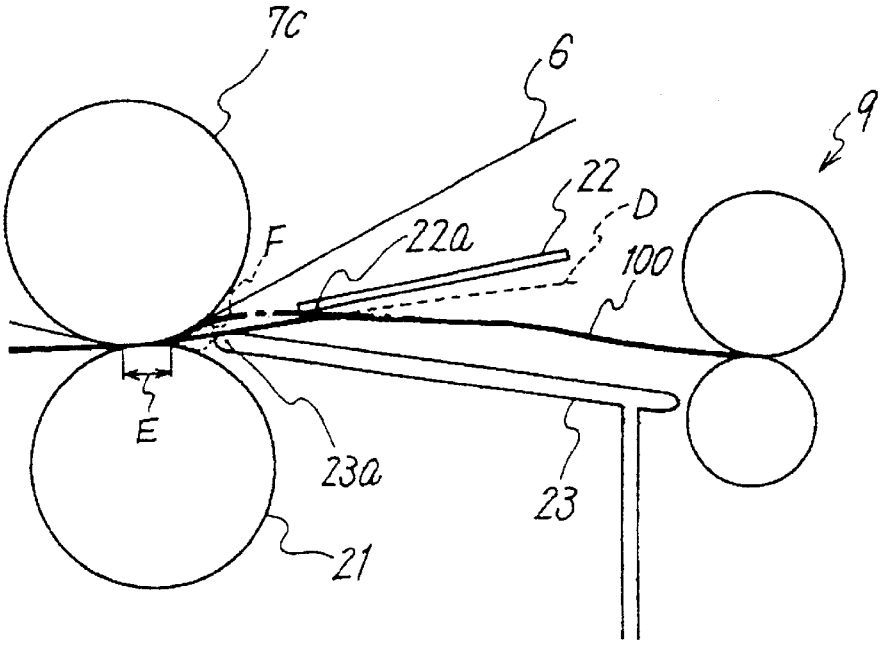
FIG. 2 PRIOR ART
FIG. 2 is a view showing the arrangement of a first and a second guide member included in the apparatus of FIG. 1.

The second cause relates to a manner in which guide members guide the paper sheet 100 to the nip E. FIG. 2 shows the position of the guide member 22 and the position of a guide member 23. Assume a reference line D (dashed line) connecting the inlet of the nip E and the downstream end 23*a* of the guide member or second guide member 23 in the direction of conveyance. Then, the guide member or first guide member 22 has a downstream end 22*a* located at the belt 6 side with respect to the reference line D. In this condition, the paper sheet 10 is allowed to move between the guide members 22 and 23 toward the nip E in a relatively free position. Specifically, the paper sheet 100 enters the nip E in some different positions, depending on the thickness and curl of the paper sheet as well as a difference in conveying speed between the registration roller pair, labeled 9, and the transfer roller 21. Specific positions of the paper sheet 100 are indicated by a solid line and a dash-and-dot line in FIG. 2.

More specifically, assume that the paper sheet 100 is as high in flexibility as a plain paper sheet. Then, the paper sheet 100 advances along the first guide member 22 toward the nip E in such a manner as to rub the downstream end 23*a* of the second guide member 23, as indicated by the solid line. The paper sheet 100 then substantially directly enters the nip E. At this instant, the paper sheet 100 contacts one of the belt 6 and transfer roller 21 before contacting the other of them. When the paper sheet 100 contacts the transfer roller 21 first, it is spaced from the belt 6 in the pretransfer region F. Which of the belt 6 and transfer roller 21 the paper sheet 100 contacts first is dependent on delicate conditions including the thickness and the degree of curl of the paper sheet 100. It is therefore extremely likely that the paper sheet 100 contacts the transfer roller 21 first and then enters the nip E and is therefore spaced from the belt 6 in the pretransfer region F.

On the other hand, when the paper sheet 100 is as low in flexibility as a thick paper sheet, it enters the nip E along the flat portion 6*a* of the belt 6, FIG. 1, as indicated by the dash-and-dot line. In this case, the paper sheet 100 bends around the inlet of the nip E, as stated earlier in relation to the first cause. The bend of the paper sheet 100 increases with an increase in the distance between the position where the leading edge of the paper sheet 100 contacts the flat portion 6*a* and the inlet of the nip E. While such a bend of the paper sheet 100 occurs between the registration roller pair 9 and the nip E, the bend is likely to occur even in the pretransfer region F and cause the paper sheet 100 to part from the belt 6.

The two causes described above also hold even when the image carrier is implemented as, e.g., a drum.

Preferred embodiments of the present invention capable of solving the problems discussed above will be described hereinafter.

First Embodiment

Figure 3:
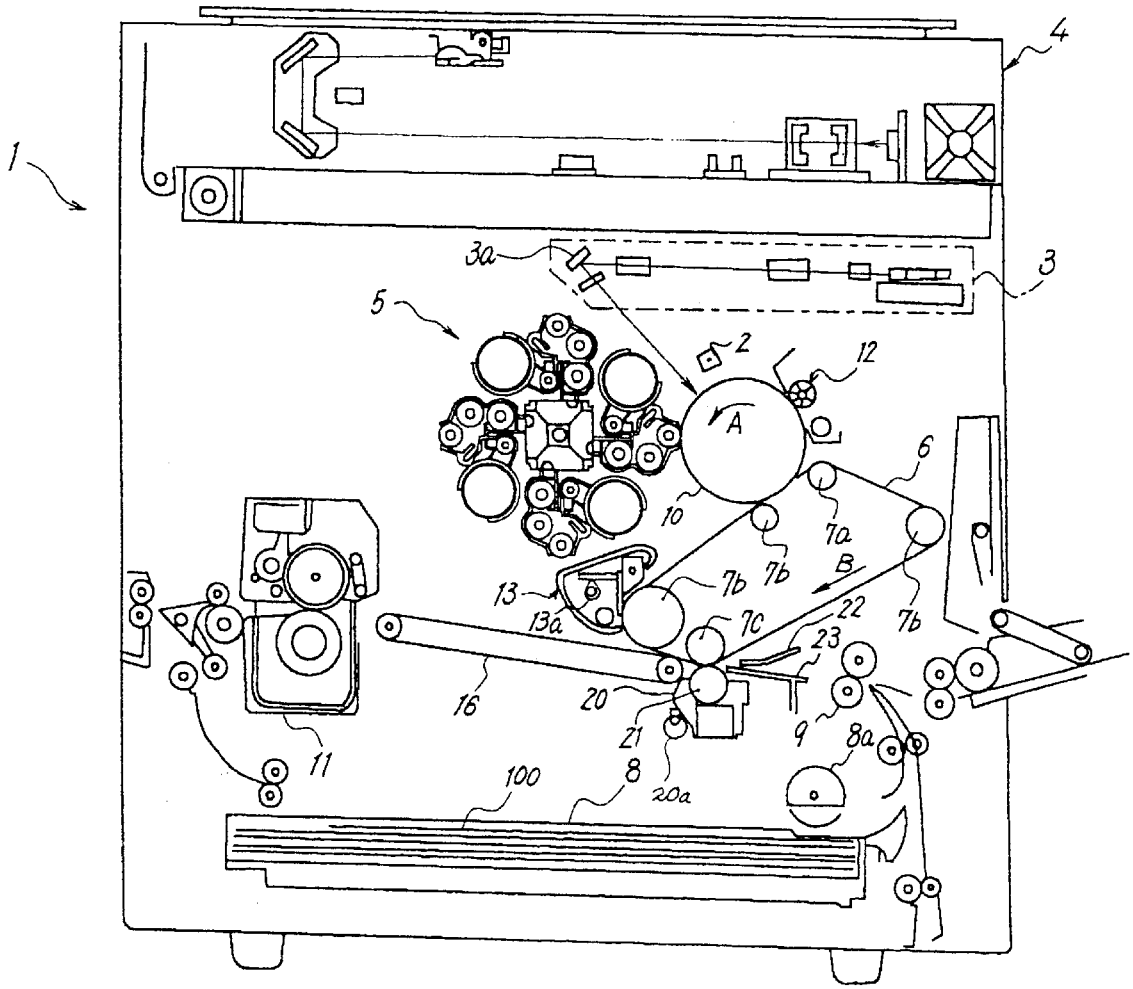
FIG. 3 is a view showing a first embodiment of the image forming apparatus in accordance with the present invention.

An image forming apparatus embodying the present invent ion and implemented as a full-color copier by way of example will be described with reference to FIG. 3. As shown, the copier, generally 1, includes an intermediate transfer belt or image carrier (simply belt hereinafter) 6. When a sensor, not shown, senses a mark formed in a non-image area of the belt 6, an image forming process begins. In the case of a monochromatic image, the image forming process may begin without the sensor sensing the mark formed on the belt 6. While a photoconductive drum or image carrier (simply drum hereinafter) 10 is driven to rotate in a direction indicated by an arrow A, a charger or charging unit 2 uniformly charges the surface of the drum 10. A laser optics 3 scans the charged surface of the drum 10 with a laser beam in accordance with image data via a mirror 3*a*. As a result, a latent image is electrostatically formed on the drum 10.

Specifically, a scanner or image reading unit 4 reads a document and outputs the resulting image data. The image data is subjected to adequate image processing. The image data are color-by-color image data produced by separating a desired full-color image into yellow, magenta, cyan and black color data. A revolver type developing unit 5 develops the latent image formed on the drum 10 with corresponding one of yellow, magenta, cyan and black toner, thereby producing a corresponding toner image on the drum 10.

The belt 6 is passed over a bias roller 7*a* assigned to primary transfer, a plurality of rollers 7*b*, and a counter roller 7*c*. The belt 6 is caused to run in a direction indicated by an arrow B in synchronism with the rotation of the drum 10. A yellow, a magenta, a cyan and a black toner images sequentially formed on the drum 10 are sequentially transferred to the belt 6 one above the other, completing a full-color image on the drum 10 (primary transfer). For this primary transfer, a preselected bias is applied to the bias roller 7*a* at the position where the drum 10 and belt 6 contact each other.

A pickup roller 8*a* feeds a paper sheet 100 from a paper cassette 8 to a registration roller pair 9. The registration roller pair 9 conveys the paper sheet 100 at a preselected timing, so that the full-color image is transferred from the belt 6 to the paper sheet 100. More specifically, the paper sheet 100 driven by the registration roller pair 9 passes through a gap between a first and a second guide member 22 and 23, respectively, and then reaches a secondary transfer region where the counter roller 7*c* faces a transfer roller or elastic transfer member 21, which is included in a secondary transfer unit 20. A cam 20*a* causes the secondary transfer unit 20 to selectively move into or out of contact with the belt 6 at a preselected timing. The transfer roller 21 is brought into contact with the belt 6 via the paper sheet 100 at the time when the paper sheet 100 enters the secondary transfer region. Positioning means, not shown, included in an intermediate transfer unit maintains the transfer roller 21 parallel to the counter roller 7*c*.

When the transfer roller 21 contacts the belt 6, the roller 21 forms a nip between it and part of the belt 6 passed over the counter roller 7*c*. A positioning roller, not shown, associated with the transfer roller 21 maintains the pressure between the transfer roller 21 and the belt 6 constant. A bias for secondary image transfer, which is opposite in polarity to the toner, is applied to the transfer roller 21 in order to transfer the full-color image from the belt 6 to the paper sheet 100 at the above nip (secondary transfer). A conveyor belt 16 conveys the paper sheet 100 carrying the toner image thereon to a fixing unit 11. After the fixing unit 11 has fixed the toner image on the paper sheet 100, the paper sheet or copy 100 is driven out of the copier body.

A drum cleaning unit 12 removes the toner left on the drum 10 after the primary transfer of the full-color image to the belt 6, thereby preparing the drum for the next image formation. Likewise, a belt cleaning unit 13 adjoins the belt 6 and removes the toner left on the belt 6 after the secondary transfer of the full-color image to the paper sheet 100. A cam 13*a* causes the belt cleaning unit 13 to selectively move into and out of contact with the belt 6 at a preselected timing.

Figure 4:
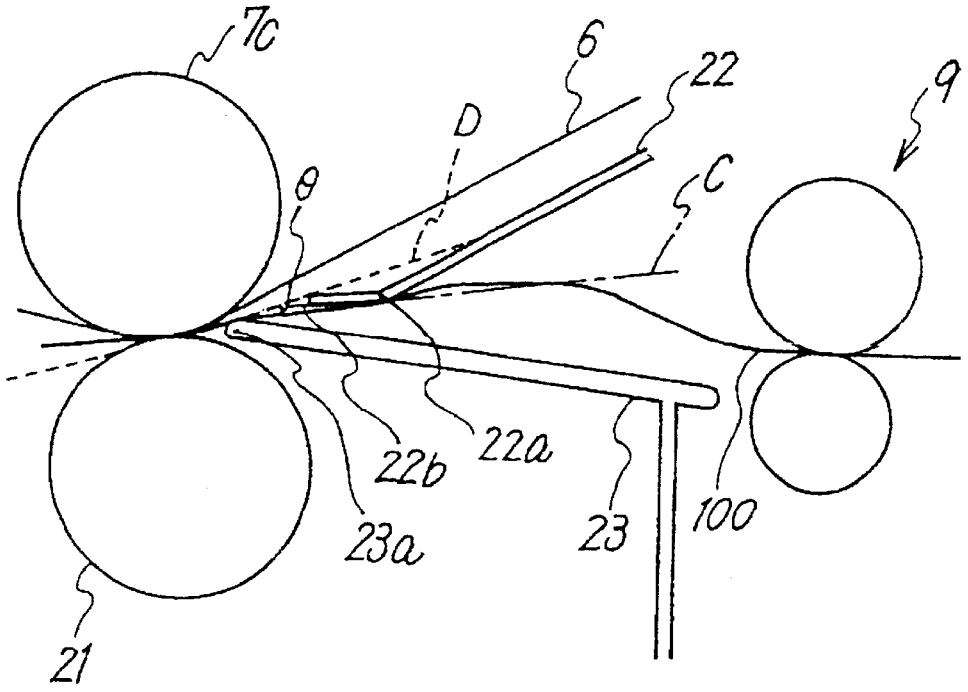
FIG. 4 is a view showing part of the first embodiment around a nip for image transfer.

FIG. 4 shows the arrangement of the guide members 22 and 23 in detail that is the characteristic feature of the illustrative embodiment. As shown, the guide members 22 and 23 guide the paper sheet 100 coming out of the registration roller pair 9. More specifically, the guide members 22 and 23 respectively guide one side of the paper sheet 100 expected to carry the toner image and the other side of the same. Assume a line C (dash-and-dot line) connecting a restriction point 22*a* included in the first guide member 22 and the inlet of a nip between the transfer roller 21 and the belt 6. Then, the second guide member 23 has an end or restriction point 23*a* located at the belt 6 side with respect to the line C. When the paper sheet 100 enters the above nip via the gap between the two guide members 22 and 23, the restriction point 23*a* of the guide member 23 forces part of the paper sheet 10 positioned between the guide members 22 and 23 toward the belt 6. As a result, the inlet of the nip, the restriction point 22*a* of the guide member 22 and the restriction point 23*a* of the guide member 23 cooperate to make the paper sheet 100 convex toward the belt 6.

In the above condition, a force forcing the paper sheet 100 against the belt 6 acts around the nip with the end 23*a* of the guide member 23 serving as a fulcrum. Consequently, forces tending to release the paper sheet 100 from the belt 6 are suppressed. That is, the paper sheet 100 is prevented from parting from the belt 6 in the pretransfer region.

When the paper sheet 10 is deformed, as stated above, contact resistance between the guide members 22 and 23 and the paper sheet 100 exerts resistance to the movement of the paper sheet 100. In this sense, the guide members 22 and 23 play the role of movement resistance members. The contact resistance successfully causes the paper sheet 100 to stretch between the inlet of the nip and the end 23*a* of the guide member 23 and closely contact the belt 6. The paper sheet 100, however, intensifies the above contact resistance if bent excessively, deteriorating the conveyance of the paper sheet 100. As a result, at the moment when the trailing edge of the paper sheet 100 leaves the registration roller pair 9, the conveying force sharply decreases because the conveying force of the registration roller 9 is not available. Consequently, at the above moment, the toner image being transferred to the paper sheet 100 is dislocated, extended or otherwise made defective. When the conveyance is further deteriorated, it is likely that the paper sheet 100 is practically brought to a stop. This is particularly true when the paper sheet 100 is a postcard or similar relatively thick paper sheet.

In light of the above, in the illustrative embodiment, the line C and a reference line D (dashed line), which connects the end 23*a* of the guide member 23 and the inlet of the nip, make an angle θ of 10° therebetween. By so arranging the two guide members 22 and 23, it is possible to maintain even a postcard or similar paper sheet 100 in close contact with the belt 6 in the pretransfer region while lowering the contact resistance between the two guide members 22 and 23 and the paper sheet 100. The paper sheet 100 can therefore be adequately conveyed. When the angle θ is between 0° and 25°, the force acting on the paper sheet 100 and derived from the contact resistance can be smaller than the frictional force acting between the transfer roller 21 and belt 6 and the paper sheet 100. This further promotes the adequate conveyance of the paper sheet 100.

In the illustrative embodiment, the counter roller 7*c* and transfer roller 21 have the same diameter of 30 mm. It follows that the belt 6 has a radius of curvature of about 15 mm, as measured at the nip. It has heretofore been difficult to provide the counter roller 7*c* with a diameter of 40 mm or less from the pretransfer prevention standpoint. By contrast, even the counter roller 7 whose diameter is 40 mm or less successfully obviates the scattering of toner on the paper sheet 100 because the paper sheet 100 closely contacts the belt 6 in the pretransfer region.

In the illustrative embodiment, the paper sheet 100 delivered from the registration roller pair 9 contacts the first guide member 22, advances along the surface of the guide member 22, and then contacts the belt 6 at a point spaced from the inlet of the nip by 5 mm. The guide member 22 has a body portion implemented by an aluminum sheet and is fixed in place at its upstream end in the direction of conveyance. Therefore, neither the body portion nor the restriction point 22*a* of the guide member is displaced during the conveyance of the paper sheet 100. The guide member 22 can therefore guide the paper sheet 100 to the nip via substantially the same route without regard to the kind of the paper sheet 100.

In the illustrative embodiment, the paper sheet 100 is brought into contact with the belt 6 at a point spaced from the inlet of the nip by 5 mm. However, the close contact of the paper sheet 100 with the belt 6 in the pretransfer region is achievable only if the above distance lies in the range of from 3 mm to 30 mm. If the distance is smaller than 3 mm, it is extremely likely that the paper sheet 100 contacts the transfer roller 21 before the belt 6 due to irregularity in the substantial contact position, which is ascribable to, e.g., the curl of the paper sheet 100, resulting in pretransfer. On the other hand, if the distance is greater than 30 mm, it is necessary to locate the end 23*a* of the second guide member 23 remoter from the nip. This makes it more probable that the paper sheet 100 again parts from the belt 6 at a position downstream of the end 23*a* of the guide member 23. To sufficiently reduce the above probability, the distance should preferably be between 5 mm and 20 mm.

In the illustrative embodiment, the paper sheet 100 bends in the convex configuration in such a manner as to push the end 23*a* of the second guide member 23 upward or to push the restriction point 22*a* of the first guide member 22 downward. Assume that the first guide member 22 is implemented only by an aluminum sheet. Then, at the moment when the trailing edge of the paper sheet 100 leaves the guide member 22, the paper sheet 100 releases its restoring force stored due to the bend. As a result, the trailing edge of the paper sheet 100 vibrates and adversely effects the close contact and image transfer in the pretransfer region.

Figure 5:
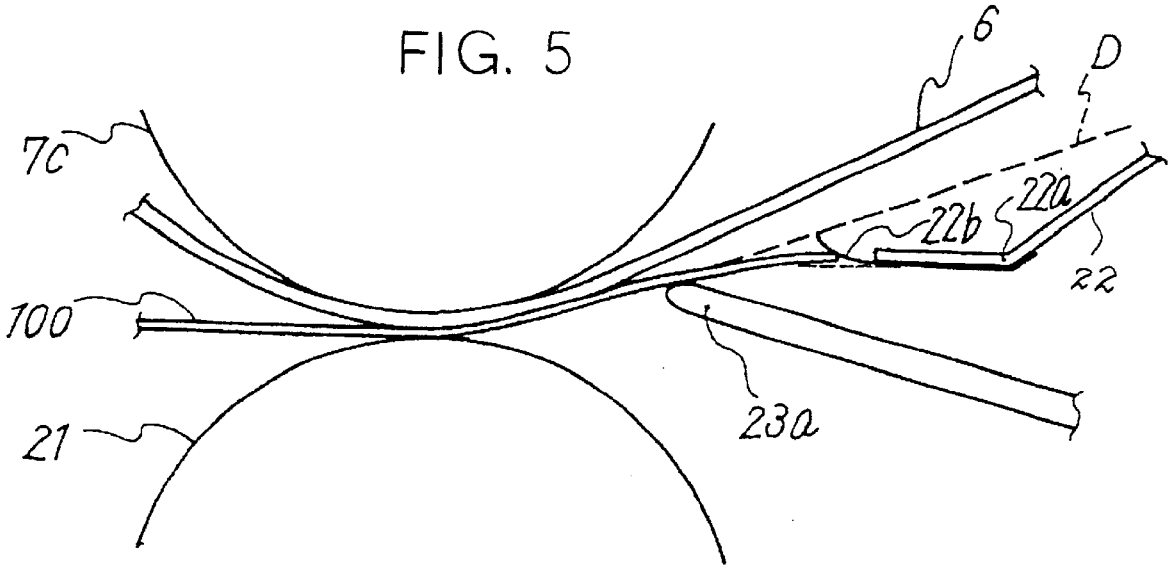
FIG. 5 is an enlarged view of the nip shown in FIG. 4.

FIG. 5 shows an implementation for obviating the above adverse effect of the paper sheet 100 and unique to the illustrative embodiment. As shown, the first guide plate 22 has a free end 22*b* implemented as an elastic movable member formed of polyethylene terephthalate. The end 22*b* protrudes from the body portion of the guide member 22 by 6 mm and is 125 μm thick. When the trailing edge of the paper sheet 100 leaves the guide member 22, the end 22*b* of the guide member 22 elastically deforms and allows the paper sheet 100 to leave the guide member 22 around the reference line D, thereby obviating the vibration of the paper sheet 100.

As stated above, the illustrative embodiment allows the paper sheet 100 to closely contact the belt 6 in the pretransfer region without regard to the kind of the paper sheet 100, while insuring adequate conveyance. The paper sheet 100 is therefore free from pretransfer, i.e., the blur of a toner image ascribable to the scattering of the toner.

While the foregoing description has concentrated on an image carrier in the form of an intermediate transfer body, the illustrative embodiment is similarly practicable when a toner image is directly transferred from the drum 10 to the paper sheet 100. The aluminum sheet, forming the body portion of the first guide member 22, may be replaced with any other suitable material so long as it does not move even when a thick paper sheet or similar paper sheet with low flexibility is conveyed. Likewise, polyethylene terephthalate, forming the end 22*b* of the guide member 22, may be replaced with any other suitable material so long as it is deformable in accordance with the bend of the paper sheet 100.

Second Embodiment

Figure 6:
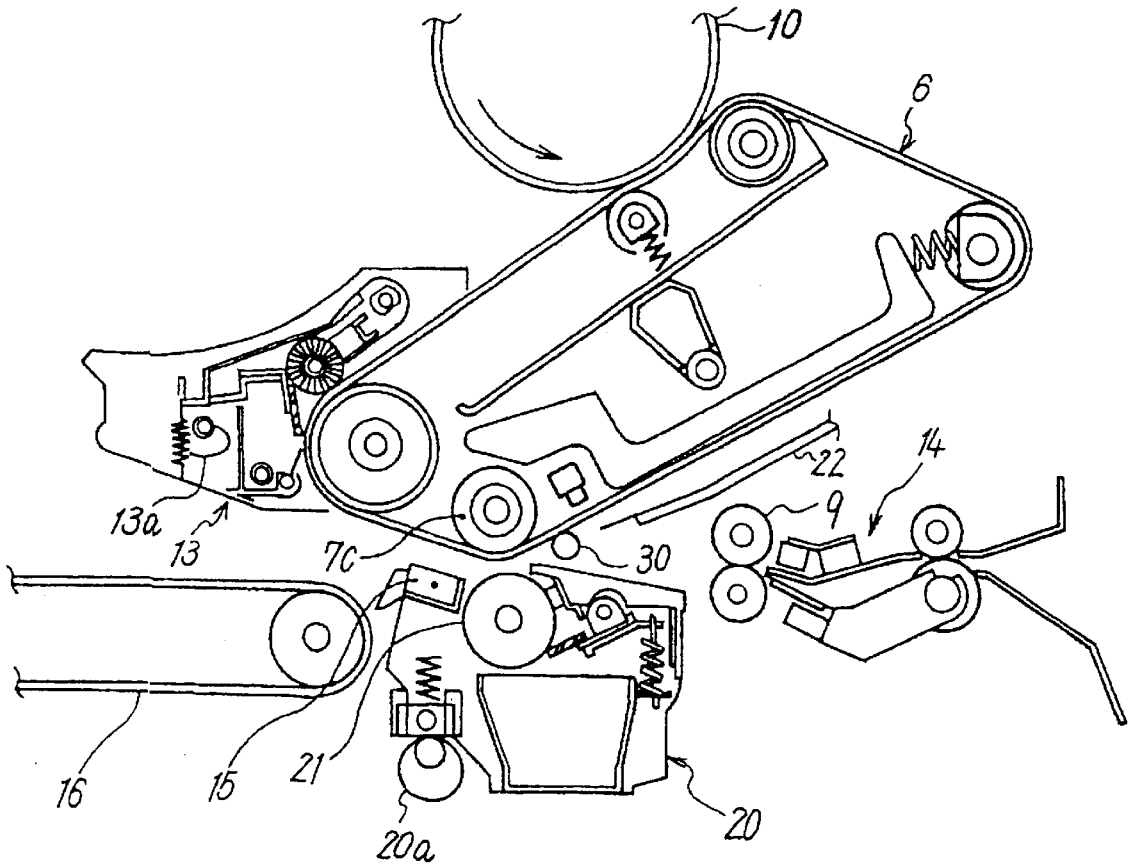
FIG. 6 is a view showing a second embodiment of the image forming apparatus in accordance with the present invention.

An alternative embodiment of the image forming apparatus in accordance with the present invention will be described with reference to FIG. 6. Again, the image forming apparatus is implemented as a full-color copier. As shown, the copier also includes the drum 10, belt 6, secondary transfer unit 20, and registration roller pair 9 that forms part of a registering section 14. The paper sheet 100 fed from the paper feeding section, not shown, is conveyed via the registering section 14 to the nip or transfer region where the belt 6 and roller 21 contact each other. After the image transfer from the belt 6 to the paper sheet 100 effected at the above nip, a discharger 15 separates the paper sheet 100 from the belt 6. Subsequently, the fixing unit, not shown, fixes the toner image on the paper sheet 100.

In the illustrative embodiment, the belt 6 is 150 $\mu$m thick and formed of, e.g., PVDF (polyvinylidene fluoride). The belt 6 has a volume resistivity of $10^8$ Ωcm to $10^{11}$ Ωcm and a surface resistivity of $10^6$ Ωcm to $10^{14}$ Ωcm. The volume resistivity was measured by a method prescribed by JIS (Japanese Industrial Standards) K6911 at 100 V for 10 seconds while the surface resistivity was measured by Hyrester available from Mitsubishi Kagaku at 500 V for 10 seconds.

A rotatable roller or pressing member 30 is positioned upstream of and in the vicinity of the nip in the direction of conveyance, playing the role of a contact assisting member. A moving device, not shown, selectively moves the roller 30 into or out of contact with the belt 6. The roller 30, when in contact with the belt 6, is driven when the leading edge of the paper sheet 100 arrives the roller 30, pressing the paper sheet 100 against the belt 6. As soon as the trailing edge of the paper sheet 100 leaves the pressing point, the roller 30 is released from the belt 6.

Figure 7:
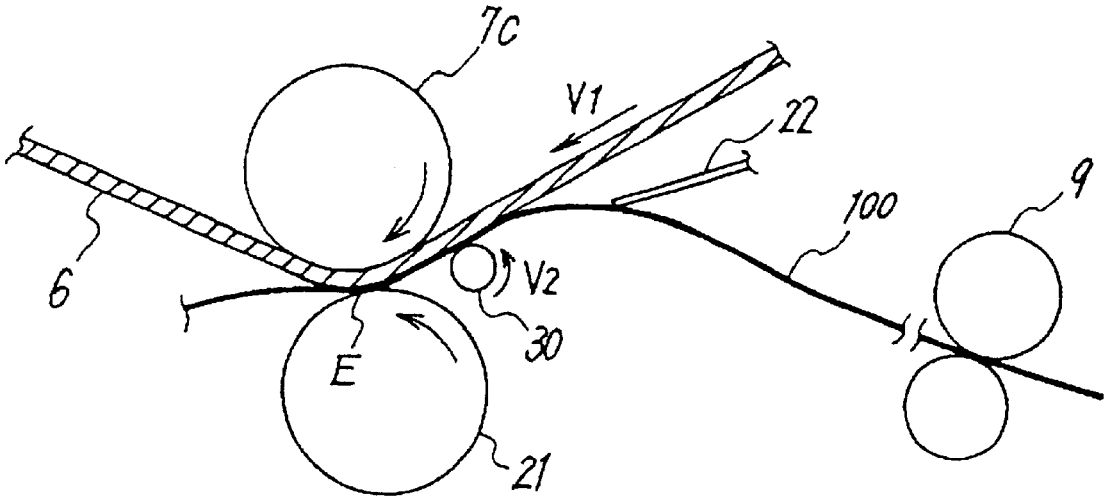
FIG. 7 is an enlarged view showing part of the second embodiment including a contact assisting member.

As shown in FIG. 7, when the registration roller pair 9 conveys the paper sheet 100 toward the nip E, the leading edge of the paper sheet 100 is guided by the first guide member 22 and abuts against the belt 6 at a point slightly upstream of the roller 30 in the direction of conveyance. The leading edge of the paper sheet 100 is then nipped by the roller 30 and the belt 6 at the time when it enters the pressing position assigned to the roller 30. The pressing position is located in a portion where the paper sheet 100 nipped at the nip E bends in a convex configuration due to the conveying force of the registration roller pair 9 and tends to part from the belt 6 due to its rebound. In this condition, no gap appears in the pretransfer region just short of the nip E, so that the toner is prevented from being scattered.

The roller 20 has an axial length as great as the entire width of the belt 6 and can therefore press the paper sheet 100 over the entire range of the paper sheet 100 in the direction perpendicular to the direction of conveyance. The roller 20 is therefore capable of dealing with paper sheets of various sizes, i.e., from extended size A3 to postcard size.

The surface of the roller 30 is formed of rubber or similar high-friction material capable of gripping the paper sheet 100. The roller 30 is therefore caused to rotate by the paper sheet 100 being conveyed. Therefore, the roller 30, following the movement of the paper sheet 100, exerts frictional resistance to the movement of the paper sheet 100. The frictional resistance causes part of the paper sheet 100 between the nip E and the roller 30 to stretch and closely contact the belt 6 in the pretransfer region.

If desired, the roller 30 may be driven by a drive source to rotate in such a manner as to move in the same direction as the paper sheet 100, as seen at the position where the former contacts the latter. In this case, assuming that the belt 6 and roller 30 have peripheral speeds of $V_1$ and $V_2$, respectively, then there should preferably hold a relation of $V_1>V_2$. When the peripheral speed $V_2$ is lower than the peripheral speed $V_1$, it is generally desirable that the difference (or ratio) in peripheral speed be small enough to have no influence on image transfer in order to achieve both of desirable image transfer and desirable contact. For this purpose, the surface of the roller 30 should preferably move in the same direction as the paper sheet 100. This causes the paper sheet 100 to stretch to an adequate degree that implements both of desirable contact and desirable conveyance. In the case where one of the paper sheet 100 and the roller 30 is formed of a material difficult to grip the other, the roller 30 may be driven to rotate in the direction opposite to the direction of movement of the paper sheet 100.

The resistance to the movement of the paper sheet 100 depends on the material forming the surface of the roller 30 and the composition of the paper sheet 100. In light of this, a controller, not shown, may control the speed at which the surface of the roller 30 moves. For example, the roller 30 may be connected to a drive source that is, in turn, controlled by the controller. This configuration allows the peripheral speed of the roller 30 to be adequately control led in accordance with the kind of the paper sheet 100, exerting stable resistance to the movement of the paper sheet 100. It follows that constant, close contact is achievable without regard to the kind of the paper sheet 100.

Further, the roller 30 may be reversibly rotated in accordance with the kind of the paper sheet 100, i.e., a thick or a thick paper sheet. In addition, the difference in linear velocity between the roller 30 and the belt 6 should preferably be controllable for implementing stable, close contact over a broader range of paper sheets.

Figure 8:
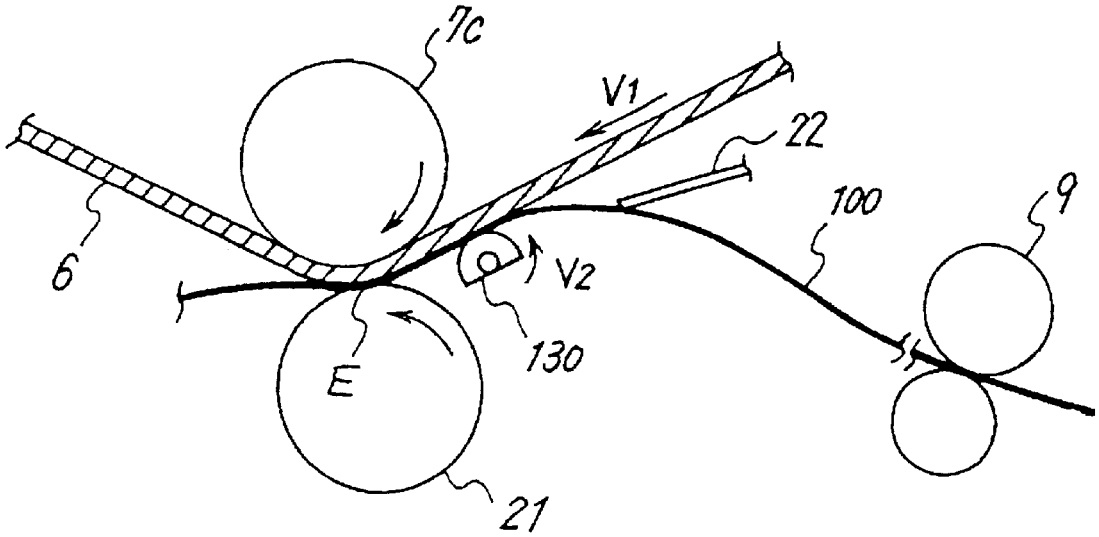
FIG. 8 is a view showing a modification of the contact assisting member of FIG. 7

FIG. 8 shows a roller 130 that is a modified form of the roller 130 and identical in function with the roller 130. The roller 130 differs from the roller 130 in that it is comparatively short and presses the paper sheet 100 against the belt 6 over only part of the entire width of the belt 6. More specifically, the roller 130 is not configured to obviate a small gap in the pretransfer region, but is configured to stretch the paper sheet 10 with the resistance to the movement of the paper sheet 10 and thereby obviate a gap. While the roller 130 may have a circular cross-section, it may have a semicircular cross-section, as shown in FIG. 8. The short roller 130, also playing the role of a contact assisting member, is low cost and simple. A plurality of short rollers 130 may be arranged in the widthwise direction of the belt 6, if desired.

While the illustrative embodiment, like the previous embodiment, uses the transfer roller 21, it is similarly practicable with an image forming apparatus of the type using a transfer belt or a transfer charger in place of the transfer roller 21.

In any one of the embodiments shown and described, a plurality of rollers 30 or 130 may be arranged in the direction of paper conveyance. While the foregoing description has concentrated on a copier, the present invention is, of course, applicable to any other image forming apparatus, e.g., a printer.

In summary, it will be seen that the present invention provides an image forming apparatus, an image transferring device and a recording medium conveying method having various unprecedented advantages, as enumerated below.

(1) An image carrier and a recording medium closely contact each other in a pretransfer region, so that pretransfer and therefore a defective image is obviated.

(2) Existing guide members are usable and obviate the need for extra members, implementing a low cost, space saving configuration. While the angles of a first and second guide member with respect to the inlet of a nip have heretofore been restricted, the present invention is free from such a restriction and has a sufficient margin as to layout.

(3) The vibration of a recording medium is obviated without causing toner on the image carrier to smear the first guide or disturbing a toner image on the image carrier. This realizes both of stable, close contact of the recording medium in the pretransfer region and constant image transfer at the nip.

(4) The recording medium enters the nip in substantially the same configuration without regard to the kind thereof, also realizing constant, close contact in the pretransfer region.

(5) The apparatus is small size and light weight.

(6) Even if the image carrier has a small radius of curvature, close contact in the pretransfer region is achievable without fail.

(7) The recording medium surely contacts an intermediate transfer body without any gap from a transfer region to the pretransfer region upstream of the transfer region in the direction of conveyance. Attractive images are therefore easily achievable.

(8) The recording medium closely contacts the intermediate transfer body over a broad range including the upstream portion of the pretransfer region in the direction of medium conveyance.

(9) The scattering of toner is surely obviated over the entire width of the recording medium.

(10) The warp of the recording medium, which brings about a gap in the pretransfer region, is obviated, so that the close contact of the recording medium and intermediate transfer body is enhanced.

(11) A movement resistance member occupies a minimum of space in the widthwise direction of the recording medium, further enhancing space saving.

(12) Unstable medium conveyance in the transfer region ascribable to resistance to movement is suppressed in order to reduce the dislocation of a toner image and other troubles.

(13) Only if the speed at which the surface of a rotary driven member moves is control led, adequate resistance to movement necessary for maintaining close contact is attained.

(14) The close contact of the recording medium and intermediate transfer body is maintained without regard to the kind of the recording medium.

Various modifications will become possible for those skilled in the art after receiving the teachings of the present disclosure without departing from the scope thereof.

What is claimed is:

1. An image forming apparatus comprising:

an image carrier;

an elastic transfer member configured to contact said image carrier to form a nip for electrostatically transferring a color image from said image carrier to a recording medium and configured to cause said recording medium to be conveyed into said nip;

a first guide member configured to guide a first side of the recording medium into said nip, wherein said first guide member comprises a first restriction point; and a second guide member configured to guide a second side of the recording medium into said nip, wherein said second guide member comprises a second restriction point, wherein said second restriction point is located downstream from said first restriction point in a direction of conveyance of said recording medium, wherein a reference plane is defined by said nip and said second restriction point, wherein said elastic transfer member is on a first side of said reference plane and said image carrier is on a second side of said reference plane, and wherein said first restriction point is on said first side of the reference plane.

2. An apparatus as claimed in claim 1, wherein a free end of said first guide member is deformable such that when the trailing edge of the recording medium moves away from said free end, said free end adjoins the reference plane.

3. An apparatus as claimed in claim 2, wherein the free end of said first guide member is formed of an elastic material so as to be deformable when the recording medium exerts a force on said free end when leaving said free end.

4. An apparatus as claimed in claim 3, wherein the recording medium initially contacts said image carrier at a distance of 3 mm to 30 mm from the nip.

5. An apparatus as claimed in claim 3, wherein a part of said image carrier forming the nip has a radius of curvature of 10 mm to 20 mm.

6. An apparatus as claimed in claim 5, wherein the recording medium initially contacts said image carrier at a distance of 3 mm to 30 mm from the nip.

7. An apparatus as claimed in claim 3, wherein a portion of said first guide member located furthest from said nip is not deformable.

8. An apparatus as claimed in claim 7, wherein the recording medium being conveyed toward the nip initially contacts said image carrier at a distance of 3 mm to 30 mm from the nip.

9. An apparatus as claimed in claim 7, wherein a part of said image carrier forming the nip has a radius of curvature of 10 mm to 20 mm.

10. An apparatus as claimed in claim 9, wherein the recording medium being conveyed toward the nip initially contacts said image carrier at a distance of 3 mm to 30 mm from the nip.

11. An apparatus as claimed in claim 1, wherein a portion of said first guide member furthest from said nip is not deformable.

12. An apparatus as claimed in claim 11, wherein the recording medium being conveyed toward the nip initially contacts said image carrier at a distance of 3 mm to 30 mm from the nip.

13. An apparatus as claimed in claim 11, wherein a part of said image carrier forming the nip has a radius of curvature of 10 mm to 20 mm.

14. An apparatus as claimed in claim 13, wherein the recording medium being conveyed toward the nip initially contacts said image carrier at a distance of 3 mm to 30 mm from the nip.

15. An apparatus as claimed in claim 1, wherein a part of said image carrier forming the nip has a radius of curvature of 10 mm to 20 mm.

16. An apparatus as claimed in claim 15, wherein the recording medium being conveyed toward the nip initially contacts said image carrier at a distance of 3 mm to 30 mm from the nip.

17. An apparatus as claimed in claim 1, wherein the recording medium being conveyed toward the nip initially contacts said image carrier at a distance of 3 mm to 30 mm from the nip.

18. A method comprising steps of:

conveying and guiding a recording medium to a nip; and electrostatically transferring an image to the recording medium at the nip, wherein an elastic transfer member is configured to contact an image carrier to form the nip for electrostatically transferring an image from the image carrier to the recording medium, wherein a first guide member, comprising a first restriction point, is configured to guide a first side of the recording medium into said nip, wherein a second guide member is configured to guide a second side of the recording medium into the nip, the second guide member comprising a second restriction point located closer to the nip than the first restriction point, wherein a reference plane is defined by the nip and the second restriction point, wherein the elastic transfer member is on a first side of said reference plane and the image carrier is on a second side of the reference plane, and wherein said first restriction point is on said first side of the reference plane.

19. An apparatus, comprising:

means for carrying an image;

transfer means for contacting said carrying means to form a nip for electrostatically transferring an image from said carrying means to a recording medium and for causing said recording medium to be conveyed into said nip;

first means for guiding a first side of the recording medium into said nip, wherein said first guide means includes a first restriction point; and second means for guiding a second side of the recording medium into said nip, wherein said second guide means comprises a second restriction point, wherein said second restriction point is located downstream from said first restriction point in a direction of conveyance of said recording medium, wherein a reference plane is defined by said nip and said second restriction point, wherein said transferring means is on a first side of said reference plane and said carrying means is on a second side of said reference plane, and wherein said first restriction point is on said first side of the reference plane.

* * * * *